US010962281B2

(12) United States Patent
Lee et al.

(10) Patent No.: US 10,962,281 B2
(45) Date of Patent: Mar. 30, 2021

(54) REFRIGERATOR

(71) Applicant: Samsung Electronics Co., Ltd, Gyeonggi-do (KR)

(72) Inventors: Jae Bok Lee, Seongnam-si (KR); Myoung Jin Jang, Hwaseong-si (KR); Yong Bo Shim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/860,496

(22) Filed: Jan. 2, 2018

(65) Prior Publication Data

US 2018/0187966 A1 Jul. 5, 2018

(30) Foreign Application Priority Data

Jan. 3, 2017 (KR) ..... 10-2017-0000950

(51) Int. Cl.
*F25D 25/02* (2006.01)
*F25D 17/04* (2006.01)
*F25D 25/00* (2006.01)

(52) U.S. Cl.
CPC ..... *F25D 25/025* (2013.01); *F25D 17/042* (2013.01); *F25D 25/005* (2013.01); *F25D 17/045* (2013.01); *F25D 2317/0411* (2013.01)

(58) Field of Classification Search
CPC ..... F25D 25/005; F25D 25/025
USPC ..... 312/401, 402, 404, 330.1
See application file for complete search history.

(56) References Cited

U.S. PATENT DOCUMENTS

| | | | | |
|---|---|---|---|---|
| 4,250,719 | A | 2/1981 | Grimm et al. | |
| 7,363,773 | B2 | 4/2008 | Lee et al. | |
| 7,624,593 | B2 | 12/2009 | Lee et al. | |
| 9,677,806 | B2 | 6/2017 | Bischofberger et al. | |
| 2012/0146477 | A1* | 6/2012 | Bischofberger | F25D 25/025 312/404 |
| 2013/0270986 | A1* | 10/2013 | Min | B65D 25/22 312/330.1 |
| 2015/0300724 | A1* | 10/2015 | Becke | F25D 25/025 312/405 |

FOREIGN PATENT DOCUMENTS

| | | | |
|---|---|---|---|
| CN | 101071033 | A | 11/2007 |
| CN | 100359269 | C | 1/2008 |
| CN | 100365362 | C | 1/2008 |
| CN | 102483282 | A | 5/2012 |
| CN | 104903665 | A | 9/2015 |
| DE | 102009029141 | A1 | 3/2011 |

(Continued)

OTHER PUBLICATIONS

European Search Report dated May 28, 2018 in connection with European Patent Application No. 17 21 0031.

(Continued)

*Primary Examiner* — James O Hansen

(57) ABSTRACT

Disclosed herein is a refrigerator having a storage box by which the humidity in a storage compartment is controllable. The refrigerator includes a body having a storage compartment, a storage box installed to be drawable in the storage compartment, a cover located above the storage box and provided to be rotatable, a cover frame configured to support the cover, and a knob configured to rotate the cover to adjust humidity inside the storage box.

8 Claims, 12 Drawing Sheets

(56) References Cited

FOREIGN PATENT DOCUMENTS

| | | | |
|---|---|---|---|
| DE | 102012221496 | A1 | 5/2014 |
| KR | 10-2009-0133008 | A | 12/2009 |
| KR | 10-2010-0094871 | A | 8/2010 |
| WO | 2004/038311 | A1 | 5/2004 |
| WO | 2015/082279 | A1 | 6/2015 |

OTHER PUBLICATIONS

Communication pursuant to Article 94(3) EPC dated Oct. 2, 2019 in connection with European Patent Application No. 17 210 031.5, 6 pages.
Office Action dated Oct. 8, 2019 in connection with Chinese Patent Application No. 2018100046959, 18 pages.
The Second Office Action in connection with Chinese Application No. 201810004695.9 dated May 29, 2020, 12 pages.
Communication pursuant to Article 94(3) EPC in connection with European Application No. 17210031.5 dated Jul. 29, 2020, 5 pages.

* cited by examiner

REFRIGERATOR

CROSS-REFERENCE TO RELATED APPLICATION

This application is related to and claims priority to Korean Patent Application No. 10-2017-0000950 filed on Jan. 3, 2017, the disclosure of which is incorporated herein by reference.

TECHNICAL FIELD

Embodiments of the present disclosure relate to a refrigerator, and more particularly, to a refrigerator having a storage box configured to adjust humidity in a storage compartment.

BACKGROUND

A refrigerator is a household appliance capable of maintaining freshness of the food by including a storage compartment capable of storing food and a cool air supply device configured to supply cool air to the storage compartment.

A temperature of the storage compartment is maintained at a temperature within a certain range required to keep the food fresh. A storage compartment of such a refrigerator is provided with an open front surface, and the open front surface is normally closed by a door to maintain a temperature of the storage compartment.

A plurality of shelves for partitioning the storage compartment into a plurality of storage compartments and a plurality of storage boxes capable of storing items, such as food, therein are provided inside the storage compartment.

An upper portion of a storage box is in an open shape, and a cover is provided on an upper side of the storage box to close the open shape.

A gap between the storage box and the cover may be large, and thus air inside the storage box may flow into the storage compartment or cool air in the storage compartment may be excessively introduced into the storage box, thereby affecting humidity inside the storage box.

Thus, a cover is generally provided so as not to move so that a small gap may be maintained between the storage box and the cover so that the storage box is substantially sealed by the cover.

However, although the humidity inside the storage box may be maintained by such a cover and high humidity may be maintained by closing the storage box, there is a case in which a sealing function is not required, that is, in which it is necessary to maintain the humidity inside the storage box at a low level to maintain a low humidity state inside the storage box. Thus, it may be necessary to adjust the humidity inside the storage box depending on the nature of items stored in the storage box.

SUMMARY

To address the above-discussed deficiencies, it is a primary object to provide a refrigerator including an improved storage box such that the storage box may be sealed to maintain high humidity inside the storage box.

It is another aspect of the present disclosure to provide a refrigerator including an improved storage box that has a simple structure capable of adjusting humidity therein by moving a cover when it is necessary to maintain the humidity inside the storage box needs at a low level.

Additional aspects of the disclosure will be set forth in part in the description which follows and, in part, will be obvious from the description, or may be learned by practice of the disclosure.

In accordance with one aspect of the present disclosure, a refrigerator is provided, the refrigerator including a body having a storage compartment, a storage box installed to be drawable in the storage compartment, a cover located above the storage box and provided to be rotatable, a cover frame configured to support the cover, and a knob configured to rotate the cover to adjust humidity inside the storage box.

The cover frame may include a hook configured to be hook-coupled with the cover.

The cover may include a pin coupled to the hook and located on a rear surface of the cover.

The cover may be configured to have a gap with the storage box in conjunction with the knob sliding in one direction.

The cover frame may include a guide groove provided in a rear surface of the cover frame and further include an adjusting member inserted into the guide groove and configured to be engaged with the knob sliding in one direction.

The cover may include cams protruding from both sides thereof, and the adjusting member may be provided at a lower portion of the cam to move the cam.

The adjusting member may include a first adjusting member connected to the knob and second adjusting members bent and extending from both ends of the first adjusting member.

The second adjusting member may include an inclined portion configured to come into contact with the cam to move the cam in a vertical direction.

The plurality of second adjusting members may be provided, and the inclined portions thereof may have different shapes so that the second adjusting members simultaneously move the cams.

The adjusting member may include first adjusting members connected to knobs disposed on both sides of the cover frame and second adjusting members bent and extending from one end portions of the first adjusting members to move the cams.

The cover may be configured to have a gap with the storage box in conjunction with the rotating knob.

The refrigerator may further include a screw member connected to the rotating knob, configured to perform a spiral motion, and passing through the cover.

The refrigerator may further include a cover shelf located above the cover frame and configured to accommodate an item stored in the storage compartment, wherein the screw member may include a first screw member configured to pass through the cover shelf to come into contact with the cover shelf.

The screw member may further include a second screw member extending from the first screw member, and the second screw member may include a spiral portion in contact with the cover.

The cover may be engaged with the second screw member configured to perform a spiral motion and have a gap with the storage box.

The refrigerator may further include a screw member connected to the rotating knob and configured to perform a spiral motion, and an adjusting member configured to move the cover in a vertical direction in conjunction with the screw member.

In accordance with another aspect of the present disclosure, a refrigerator is provided, the refrigerator including a storage box, a cover located above the storage box and provided to be rotatable in a vertical direction to selectively close an inside of the storage box, a knob configured to adjust rotation of the cover in the vertical direction to adjust humidity inside the storage box, and an adjusting member configured to engage the knob with the cover to control rotation of the cover in the vertical direction by the knob being slid in the lateral direction.

The adjusting member may include a first adjusting member connected to the knob and second adjusting members bent and extending from both sides of the first adjusting member and configured to move the cover in the vertical direction.

In accordance with still another aspect of the present disclosure, a refrigerator is provided, the refrigerator including a storage box, a cover located above the storage box and provided to be movable in a vertical direction to selectively close an inside of the storage box, a knob configured to adjust movement of the cover in the vertical direction to adjust the humidity inside the storage box, and a screw member configured to engage the knob with the cover to control rotation of the cover in the vertical direction by the knob being rotated.

The screw member may perform a spiral motion due to rotation of the knob and include a spiral portion provided to move the cover in the vertical direction.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 12, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Embodiments described in this specification and configurations illustrated in the accompanying drawings are only exemplary examples of the disclosure. Further, identical reference numbers or symbols given in the accompanying drawings of the present specification indicate substantially the same components or components that perform substantially the same function. Further, terms used in the present specification are used only to describe exemplary embodiments and are not intended to limit and/or restrict disclosed disclosure.

An expression used in the singular encompasses an expression of the plural unless it has a clearly different meaning in the context. In the present specification, it should be understood that terms such as "including," "having," and "comprising" are intended to indicate the existence of the features, numbers, steps, actions, components, parts, or combinations thereof disclosed in the specification.

Accordingly, it is not intended to preclude the possibility that one or more other features, numbers, steps, actions, components, parts, or combinations thereof may exist or be added.

It should be understood that, although the terms "first," "second," and the like used in the present specification are used to describe various elements, the elements are not limited by the terms. The terms are only used to distinguish one element from another.

For example, a first element could be termed a second element, and, similarly, a second element could be termed a first element without departing from the scope of the present disclosure. As used herein, the term "and/or" includes any and all combinations of one or more of the associated listed items.

In addition, the terms "front side," "rear side," "upper side," and "lower side used in the present specification are defined with reference to the drawings, but the shape and position of each component are not limited thereby.

Hereinafter, a refrigerator according to an embodiment of the present disclosure will be described in detail with reference to the accompanying drawings.

Figure 1:
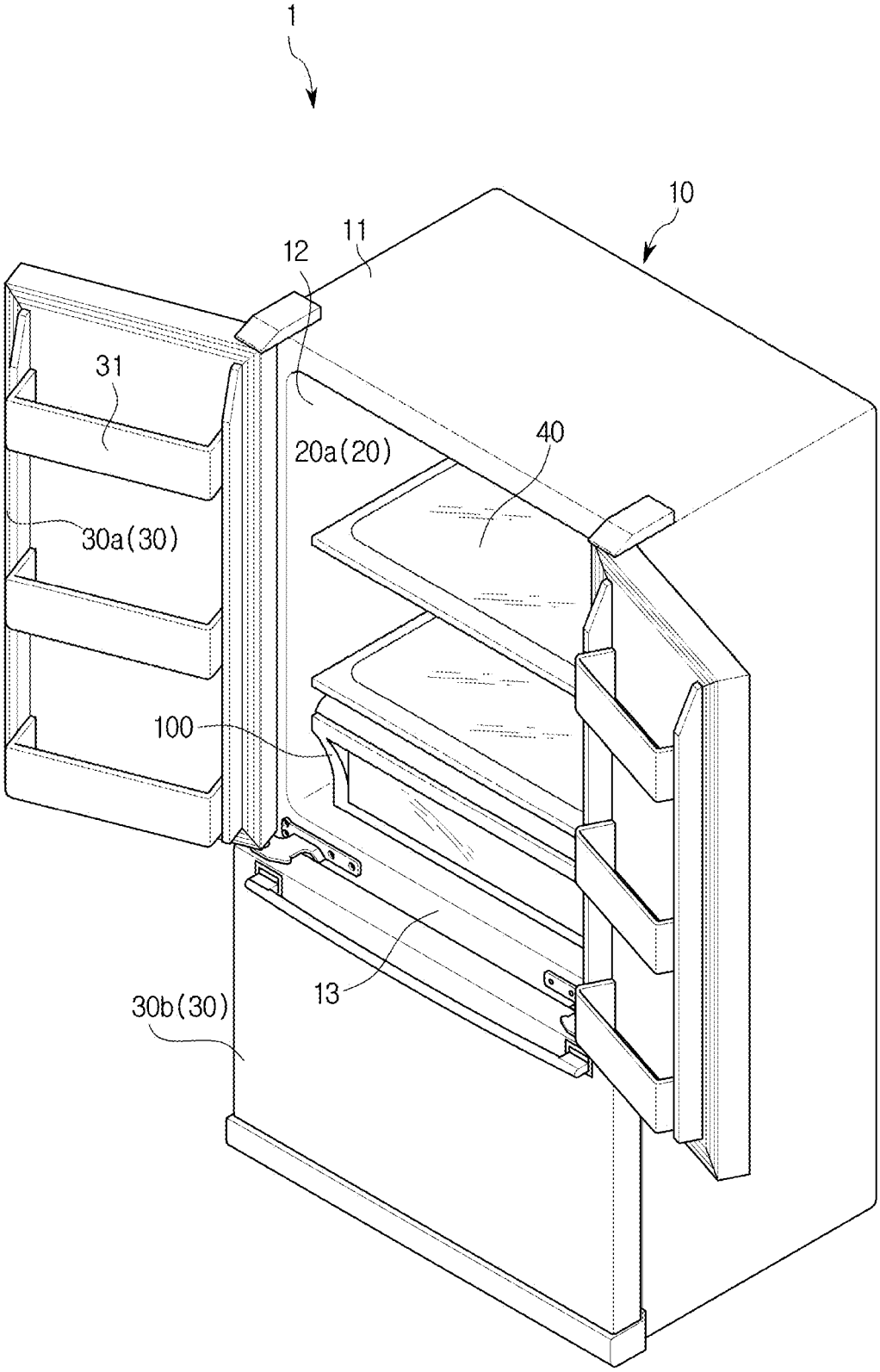
FIG. 1 is a perspective view of a refrigerator according to an embodiment of the present disclosure.

FIG. 1 is a perspective view of a refrigerator according to an embodiment of the present disclosure. As shown in FIG. 1, a refrigerator 1 may include a body 10 and a storage compartment 20 provided in the body 10 and having an open front surface so that items may be placed therein and withdrawn therefrom.

The refrigerator 1 may include a door 30 rotatably coupled to the body 10 to open and close the open front surface of the storage compartment 20, and a cool air supply device configured to supply cool air to the storage compartment 20.

The body 10 may include an outer case 11 and an inner case 12. The outer case 11 may form an exterior of the body 10. The outer case 11 may be formed of a metal material having excellent durability and aesthetics.

The inner case 12 may be located on an inner side of the outer case 11. The inner case 12 may form an exterior of the storage compartment 20. The inner case 12 may be integrally injection-molded with a plastic material.

The storage compartment 20 may be partitioned into a plurality of storage compartments 20 by a partition wall 13. The storage compartment 20 may include an upper storage compartment 20*a* and a lower storage compartment 20*b*. Each of the upper storage compartment 20*a* and the lower storage compartment 20*b* may be partitioned into a left storage compartment and a right storage compartment by another partition wall (not shown).

The storage compartment 20 may include a refrigerator compartment and a freezer compartment. Depending on the type of refrigerator, the upper storage compartment 20*a* may be provided as a refrigerating compartment and the lower storage compartment 20*b* may be provided as a freezing compartment, and conversely, the upper storage compartment 20*a* may be provided as a freezing compartment and the lower storage compartment 20*b* may be provided as a refrigerating compartment.

The refrigerator 1 shown in FIG. 1 is a bottom freezer type refrigerator in which the upper storage compartment 20*a* is provided as a refrigerating compartment and the lower storage compartment 20*b* is provided as a freezing compartment.

However, the refrigerator of the present disclosure is not limited thereto, and other types of refrigerators may be applied thereto as long as a storage box 100 may be mounted in the storage compartment 20 such as a refrigerator compartment or a freezer compartment.

Other types of refrigerators include a side-by-side type refrigerator in which a freezer compartment and a refrigerator compartment are disposed in a lateral direction, and a top mounting type refrigerator in which a freezer compartment is disposed on a refrigerator compartment.

The freezer compartment and the refrigerator compartment may be maintained at about −20° C. and about 3° C., respectively. The freezer compartment and the refrigerator compartment may be insulated by the partition wall 13.

The storage compartment 20 may be opened or closed by the door 30. The upper storage compartment 20*a* may be opened or closed by a pair of upper doors 30*a* rotatably coupled to the body 10. The lower storage compartment 20*b* may be opened or closed by a drawer type lower door 30*b* slidably coupled to the body 10.

However, the present disclosure is not limited thereto, and the door 30 may be variously provided as long as the storage compartment 20 may be opened and closed.

On a rear surface of the upper door 30*a*, a plurality of door guards 31 capable of accommodating items and the like may be provided. The door guard 31 may be provided to accommodate small volume items or the like.

The storage compartment 20 may be provided with shelves 40 capable of supporting items stored in the storage compartment 20. The plurality of shelves 40 may be provided. The shelves 40 may be installed anywhere in the refrigerator compartment or the freezer compartment.

The shelves 40 vertically disposed to be spaced apart from each other partition the inside of the storage compartment 20 into multiple stages, and thereby utilization efficiency of a storage space can be increased and items to be stored can be easily accommodated on the shelves 40.

Recently, as the refrigerator has become larger, items located deep on a rear side of the shelf 40 may not be easily withdrawn. Accordingly, the shelves 40 may be provided such that a position thereof is movable other than the position thereof being fixed.

The drawer type storage box 100 configured to store vegetables, fruits, or the like may be disposed inside the storage compartment 20. The storage box 100 may be provided to store items in a closed internal space thereof. A detailed structure of the storage box 100 will be described below.

Figure 2:
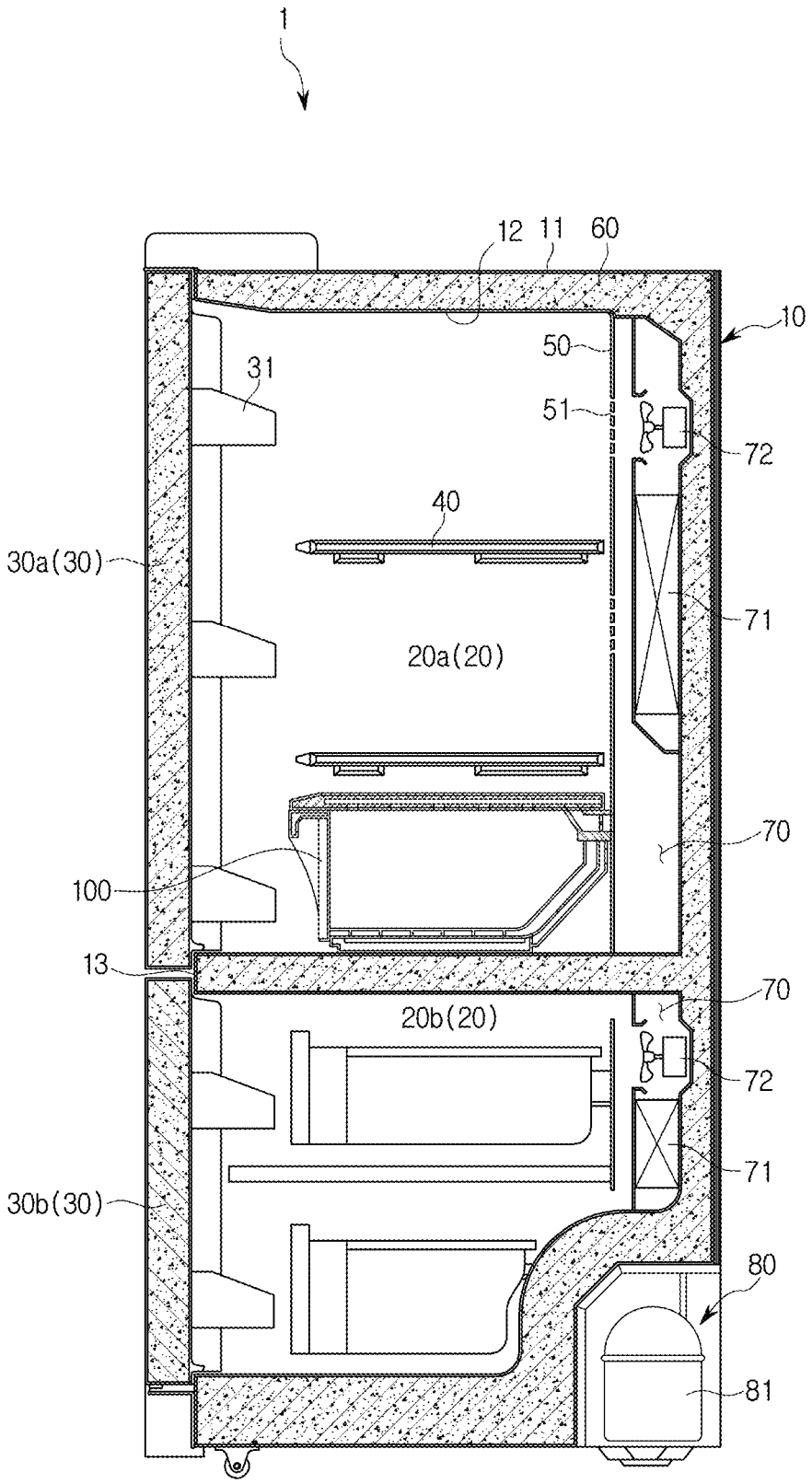
FIG. 2 is a side cross-sectional view of the refrigerator according to the embodiment of the present disclosure.

FIG. 2 is a side cross-sectional view of the refrigerator according to the embodiment of the present disclosure. As shown in FIG. 2, an insulator 60 may be foamed between the inner and outer cases 12 and 11 to prevent an outflow of cool air from the storage compartment 20.

The cool air supply device may supply cool air to the storage compartment 20. Generally, the refrigerator 1 includes components for a freezing cycle therein. The refrigerator 1 may refrigerate or freeze items stored in the storage compartment 20 via cool air generated by the components for the freezing cycle.

A cool air circulation path 70 may be formed in the rear of the storage compartment 20. An evaporator 71 configured to cool the storage compartment 20 may be installed in the cool air circulation path 70.

A cool air circulating fan 72 configured to circulate air inside the storage compartment 20 may be installed above the evaporator 71 in the cool air circulation path 70. A panel 50 configured to partition the cool air circulation path 70 and the storage compartment 20 may be installed in front of the evaporator 71.

The panel 50 may be provided with a cool air discharger 51 for discharging cool air guided through the cool air circulation path into the storage compartment 20. The cool air circulating fan 72 may blow air passing through the evaporator 71 into the cool air circulation path 70.

A machine room 80 partitioned from the storage compartment 20 may be provided in a lower portion of the body 10. A compressor 81 configured to compress a refrigerant, a condenser (not shown) configured to condense the compressed refrigerant, a refrigerant expansion device (not shown) configured to expand the compressed refrigerant, and the like may be installed in the machine room 80.

A cooling principle of the refrigerator 1 is as follows. A refrigerant gas contained in the refrigerator 1 is compressed by the compressor 81 into a high-temperature and high-pressure gas, and is sent to a condenser (not shown) to release heat such that the refrigerant gas may be condensed and liquefied.

The liquefied refrigerant is in a state of being easily vaporized at a low temperature while being depressurized in a capillary tube, and the liquefied refrigerant may then be vaporized again in a low temperature evaporator 71, and heat of air surrounding the capillary tube may be transferred to the refrigerant and a temperature of the air may drop.

The cool air, that is the air with the lowered temperature, is discharged into the storage compartment 20 of the refrigerator 1, and a refrigeration or freezing function may be performed.

The vaporized refrigerant gas is sent back to the compressor 81, and the above-described process may be repeated, and such a cooling method is referred to as a gas compression type cooling method. Further, since this method is efficient and has excellent cooling power, it may be widely used in a general household.

Figure 3:
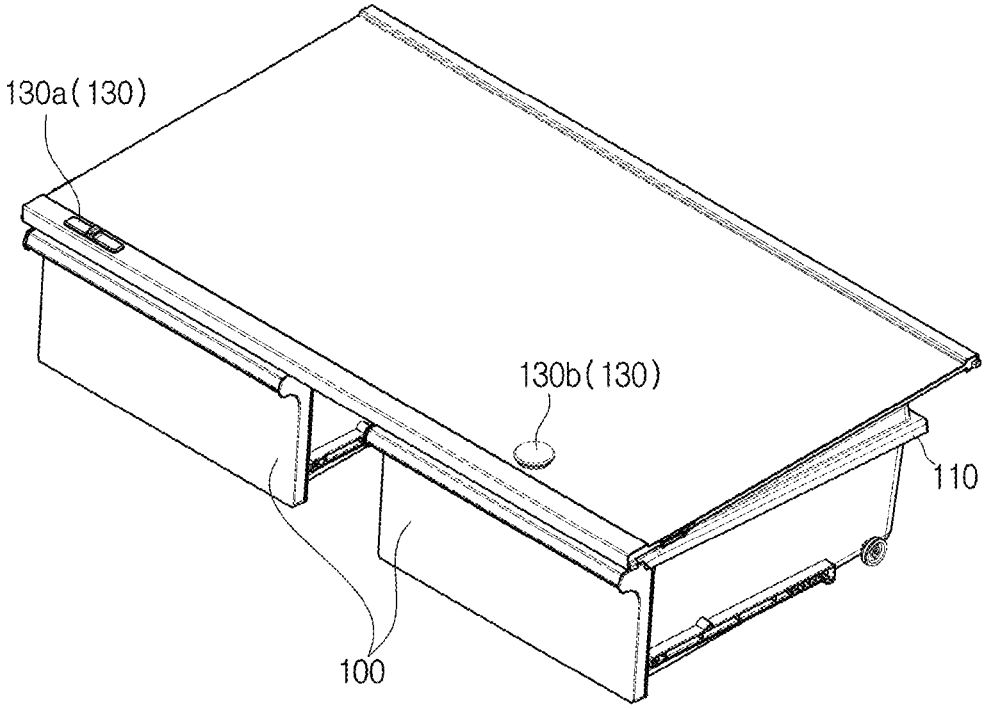
FIG. 3 is a perspective view of a storage box in the refrigerator according to the embodiment of the present disclosure.

FIG. 3 is a perspective view of a storage box in the refrigerator according to the embodiment of the present disclosure. As shown in FIG. 3, the refrigerator 1 according to the embodiment of the present disclosure may include the storage box 100 installed to be withdrawable in the storage compartment 20 and a cover 110 rotatably provided above the storage box.

A gap G may exist between the cover 110 and the storage box 100. Cool air in the storage compartment 20 may flow into the storage box 100 through the gap G such that humidity inside the storage box 100 is affected.

The gap G between the storage box 100 and the cover 110 will be described in detail below.

The refrigerator 1 according to the embodiment of the present disclosure may include cover shelves 170 capable of performing a function of a plurality of shelves 40 capable of accommodating items stored in the storage compartment 20, and partitioning the accommodation space of the storage box 100. The storage box 100 may be slidably withdrawn in a frontward direction by a roller or the like.

The refrigerator 1 according to the embodiment of the present disclosure may include a knob 130 interlocked with the cover 110 so that a user can rotate the cover 110 to adjust the humidity inside the storage box 100.

In FIG. 3, although the knob 130 is illustrated as being mounted on the cover shelf 170, the knob 130 is not limited thereto, and the knob 130 may be disposed in various places with various shapes as long as the user may operate and rotate the cover 110.

In FIG. 3, a knob 130*a* included in the refrigerator 1 according to a first embodiment and a knob 130*b* included in the refrigerator 1 according to a second embodiment are shown on one cover shelf 170, but the present disclosure is not limited thereto.

Accordingly, the refrigerator 1 according to the embodiments of the present disclosure may be configured to include various types of storage boxes 100 including the refrigerator 1 according to the first embodiment and the refrigerator 1 according to the second embodiment.

Figure 4:
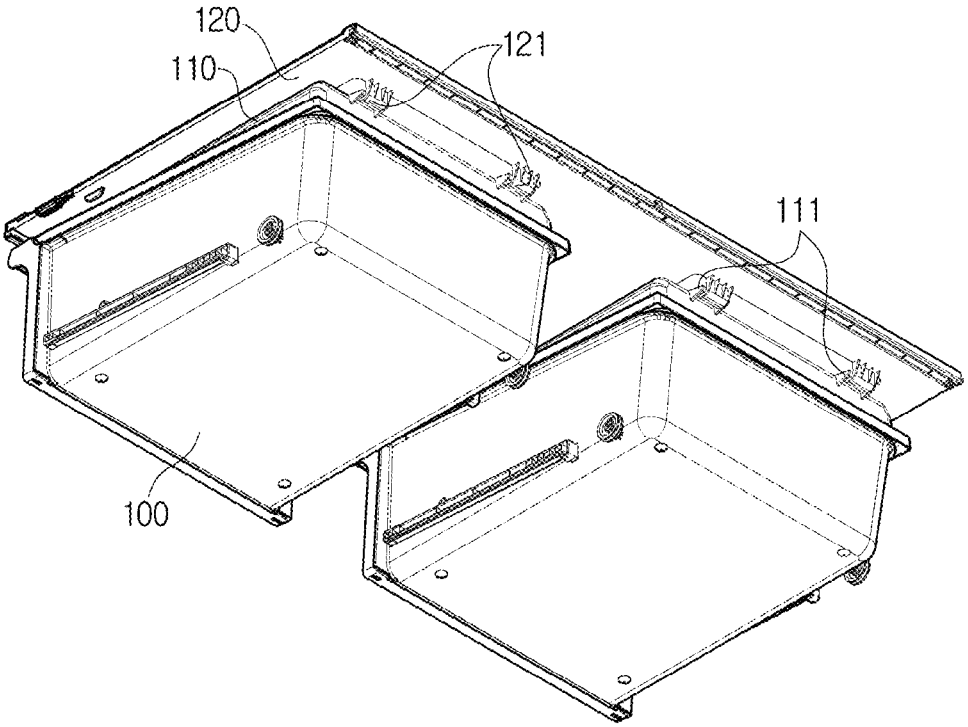
FIG. 4 is a view showing hook coupling of a cover frame and a cover in the refrigerator according to the embodiment of the present disclosure.

FIG. 4 is a view showing hook coupling of a cover frame and a cover in the refrigerator according to the embodiment of the present disclosure. As shown in FIG. 4, the refrigerator 1 according to the embodiment of the present disclosure may include a cover frame 120 for supporting the cover 110.

The cover frame 120 may include a hook 121 configured to be hook-coupled with the cover 110, and the hook 121 may be located on a rear surface of the cover frame 120. The hook 121 may be provided at a rear end portion of the cover frame 120.

The hook 121 may have a hook shape shown in FIG. 4, but is not limited thereto, and the hook 121 may have various shapes as long as it may be hook-coupled to the cover 110.

The cover 110 may include a pin 111 positioned on the rear surface of the cover 110 to be coupled to the hook 121. The pin 111 may have a "la" shape and an opening so that the hook 121 may be coupled thereto.

However, the present disclosure is not limited thereto, and the pin 111 may have various shapes as long as the pin 111 may be hook-coupled to the hook 121.

By the hook 121 and the pin 111 being hook-coupled, the cover 110 may be rotated in a vertical direction to selectively close the inside of the storage box 100.

That is, the cover 110 may be rotated in the vertical direction with respect to a rotation axis in which the hook 121 and the pin 111 are hook-coupled to each other. A radius by which the cover 110 may be rotated may be limited in an upward direction by the cover frame 120 and may be limited in a downward direction by the storage box 100. Accordingly, the cover 110 may actually rotate by a fine angle in the vertical direction.

The cover 110 is hook-coupled to the cover frame 120 and is rotated upward and downward to adjust humidity inside the storage box 100.

In FIG. 4, two hooks 121 and two pins 111 are formed, and each of the hook 121 and the pin 111 are positioned at rear end portions of the cover frame 120 and the cover 110, but the present disclosure is not limited thereto.

Accordingly, various numbers of hooks 121 and pins 111 may be provided at various positions as long as the cover 110 may be rotated via the hook 121 and the pin 111 being hook-coupled.

Figure 5:
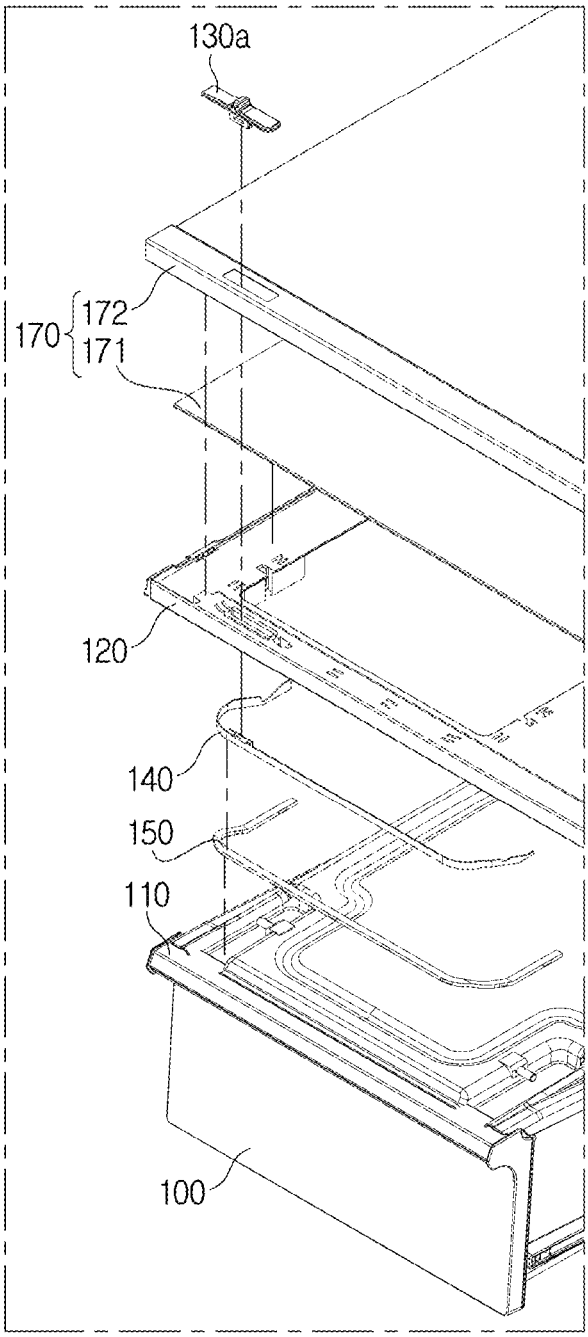
FIG. 5 is an exploded view of main components of a refrigerator according to a first embodiment of the present disclosure.

Hereinafter, embodiments of the refrigerator 1 according to the present disclosure will be mainly described FIG. 5 is an exploded view of main components of the refrigerator according to the first embodiment of the present disclosure. As shown in FIG. 5, the cover 110 may be disposed above the storage box 100, and the cover frame 120 may be disposed above the cover 110.

The cover shelves 170 may be disposed above the cover frame 120 and may include a glass shelf 171 made of a glass material and a metal shelf 172 made of a metal material.

The glass shelf 171 may be fitted into and engaged with the cover frame 120, and the metal shelf 172 may be positioned above the glass shelf 171 and engaged with the cover frame 120 to cover the cover frame 120.

The refrigerator 1 according to the first embodiment of the present disclosure may include the knob 130*a* installed on the cover frame 120 and an adjusting member 140 connected to the knob 130*a*.

The refrigerator 1 according to the first embodiment may include an adjusting trim 150 to which the adjusting member 140 may be fixed. A detailed structure of the adjusting member 140 and the adjusting trim 150 will be described below.

The knob 130*a* may have a knob shape so that a user may easily grasp the knob 130*a* and may pass through the cover frame 120 and the metal shelf 172. Accordingly, the cover frame 120 and the metal shelf 172 may include holes to allow the knob 130*a* to pass therethrough.

The adjusting member 140 may have a "⊏" shape. The cover 110 included in the refrigerator 1 according to the first embodiment may be configured to be rotated in the vertical direction in conjunction with the knob 130*a* sliding in one direction.

The cover 110 may have a space in which the adjusting member 140 and the adjusting trim 150 may be received to be coupled with the adjusting member 140 and the cover frame 120 to which the adjusting trim 150 is coupled.

Figure 6:
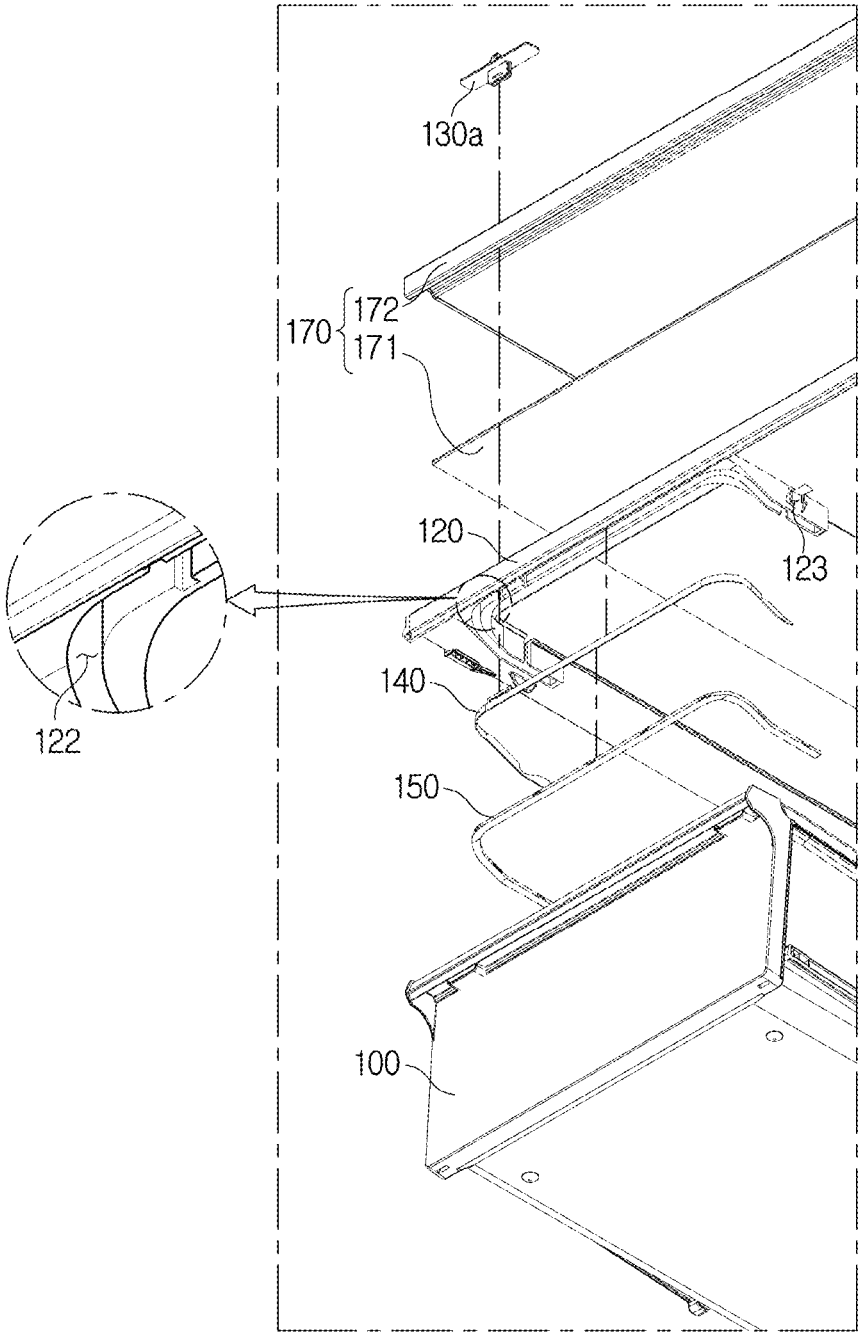
FIG. 6 is an exploded view of main components constituting a rear surface of a cover frame in the refrigerator according to the first embodiment of the present disclosure.

FIG. 6 is an exploded view of main components constituting a rear surface of the cover frame in the refrigerator according to the first embodiment of the present disclosure.

As shown in FIG. 6, the cover frame 120 may include a guide groove 122 provided in the rear surface of the cover frame 120.

The guide groove 122 may have a "⊏" shape similar to the shape of the adjusting member 140. The adjusting member 140 is inserted into the guide groove 122 and may be connected to and guided by the knob 130*a* configured to be slid in one direction.

The adjusting member 140 is inserted into the guide groove 122, and the adjusting trim 150 is coupled with the guide groove 122 to fix the adjusting member 140 in the guide groove 122.

A coupling structure of the adjusting trim 150 and the guide groove 122 may be variously formed, and, for example, the adjusting trim 150 may be fitted into and coupled with the guide groove 122 or the like.

One end of the metal shelf 172 may be bent to be coupled with the cover frame 120 while protecting the glass shelf 171.

The cover frame 120 may include cam guides 123 connected to the guide groove 122. The cam guides 123 may guide movement of cams 112 which will be described below. A detailed structure of the cam 112 and the cam guide 123 will be described below.

Figure 7:
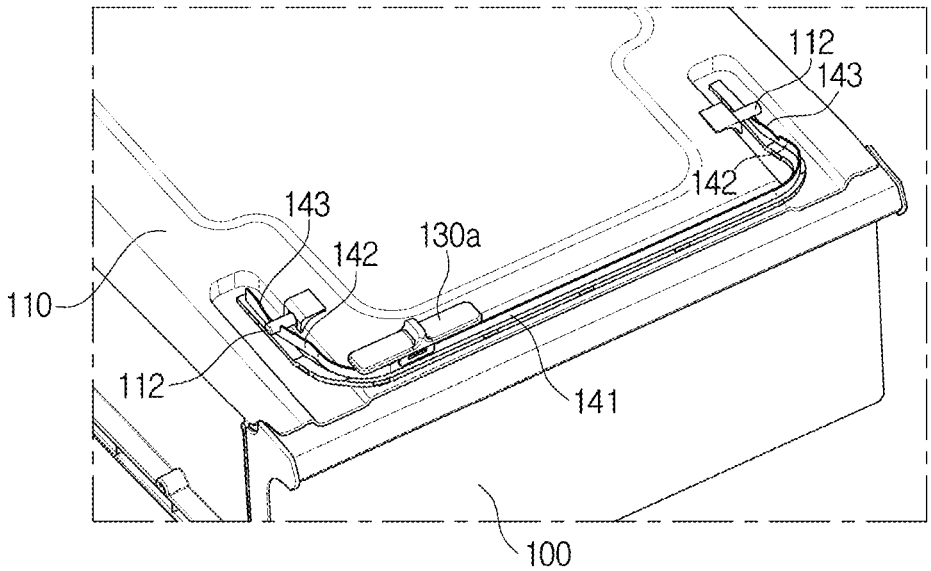
FIG. 7 is a view showing a state before the cover is rotated upward by a knob in the refrigerator according to the first embodiment of the present disclosure.
Figure 8:
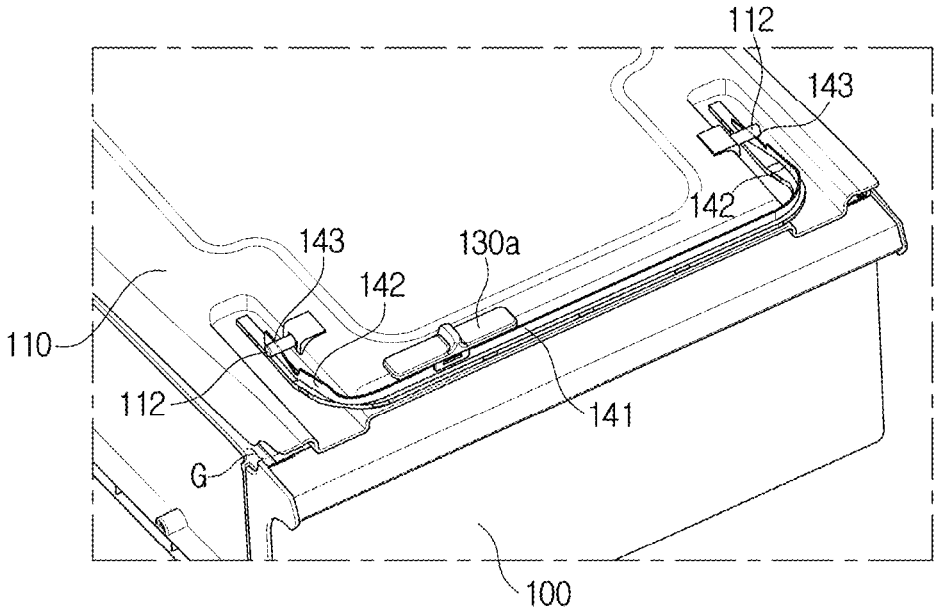
FIG. 8 is a view showing a state after the cover is rotated upward by the knob in the refrigerator according to the first embodiment of the present disclosure.

FIG. 7 is a view showing a state before the cover is rotated upward by the knob in the refrigerator according to the first embodiment of the present disclosure. FIG. 8 is a view showing a state after the cover is rotated upward by the knob in the refrigerator according to the first embodiment of the present disclosure.

As shown in FIGS. 7 and 8, the adjusting member 140 includes a first adjusting member 141 connected to the knob 130*a* and second adjusting members 142 bent and extending from both ends of the first adjusting member 141.

The cover 110 includes the cams 112 protruding from both sides thereof, and the adjusting member 140 may move the cam 112 in the vertical direction.

The second adjusting member 142 may include an inclined portion 143 provided so that the cam 112 may be moved in the vertical direction. Accordingly, before the adjusting member 140 is slid, the cam 112 may be in contact with a lowest portion of the inclined portion 143.

When the adjusting member 140 is slid, the cam 112 may be moved upward along an inclination of the inclined portion 143, and a highest portion of the inclined portion 143 may come into contact with the cam 112.

Accordingly, the first adjusting member 141 connected to the knob 130*a* by being slid in a lateral direction of the knob 130*a* may be moved in the same direction as a sliding direction of the knob 130*a*

The second adjusting member 142 may be moved in forward and backward directions in conjunction with movement of the first adjusting member 141 along the guide groove 122. The cam 112 may be moved in the vertical direction along the inclined portion 143 by the forward and backward movement of the second adjusting member 142.

By the cam 112 being moved in the vertical direction, the cover 110 may be rotated to have the gap G with the storage box 100 as a rotation axis of the hook 121 and the pin 111.

The plurality of second adjusting members 142 are provided, and the inclined portions 143 thereof may have different shapes so that the second adjusting members 142 simultaneously move the cams 112. That is, since the adjusting member 140 slides in one direction together with the sliding of the knob 130*a*, lengths of the plurality of second adjusting members 142 and positions of the inclined portions 143 may be different from each other.

The adjusting member 140 is moved in a state in which the adjusting member 140 is inserted into the guide groove 122 so that movement of the adjusting member 140 due to the sliding of the knob 130*a* may be restricted.

That is, a range of the movement of the adjusting member 140 may correspond to a range in which the cam 112 may move in the vertical direction within the cam guide 123.

Figure 9:
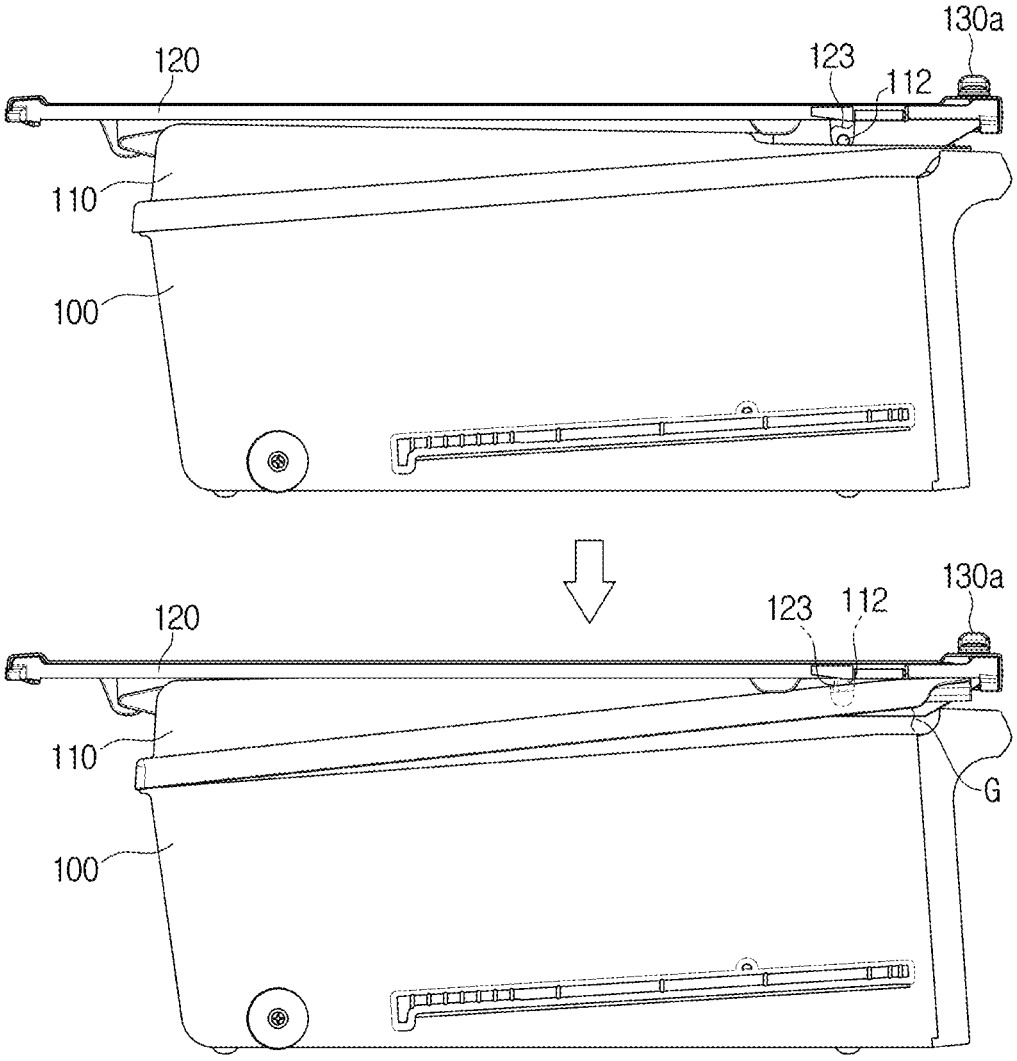
FIG. 9 is a view showing a gap between the cover and the storage box according to the embodiment of the present disclosure.

FIG. 9 is a view showing a gap between the cover and the storage box according to the embodiment of the present disclosure. As shown in FIG. 9, the cover 110 selectively closes the storage box 100 so that the humidity inside the storage box 100 may be adjusted.

The cam 112 may be guided by the cam guide 123 provided on the cover frame 120. That is, the cam 112 moved by the adjusting member 140 is guided along the cam guide 123, and the movement of the cam 112 may be restricted by the cam guide 123. The cam guide 123 may be connected to the guide groove 122.

In a state in which the cover 110 is not rotated upward, the gap G between the storage box 100 and the cover 110 is very small and may be brought into a substantially closed state, and thus high humidity may be maintained inside the storage box 100. Accordingly, freshness of food inside the storage box 100 may be maintained.

On the other hand, the gap G between the storage box 100 and the cover 110 becomes relatively large in a state in which the cover 110 is rotated upward, and thus relatively low humidity may be maintained inside the storage box 100.

Accordingly, by the cover 110 being rotated, the humidity inside the storage box 100 may be appropriately adjusted according to items stored in the storage box 100.

Figure 10:
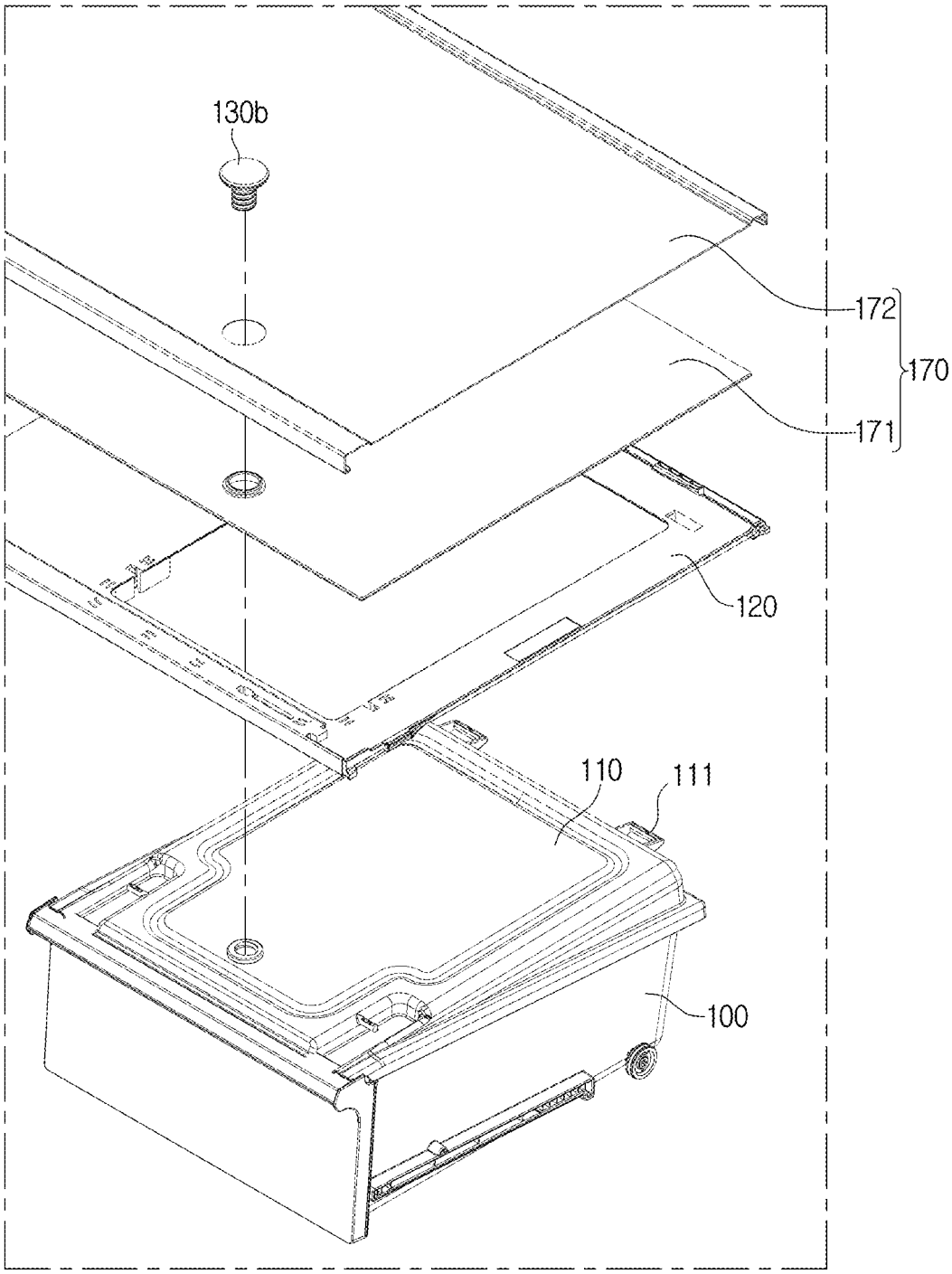
FIG. 10 is an exploded view of main components of a refrigerator according to a second embodiment of the present disclosure.

FIG. 10 is an exploded view of main components of the refrigerator according to the second embodiment of the present disclosure. As shown in FIG. 10, the refrigerator 1 according to the second embodiment differs from the refrigerator 1 according to the first embodiment in a configuration of the knob 130*b*, and most of the other main components are the same.

The knob 130*b* may be disposed to pass through the cover shelf 170 and the cover 110. Accordingly, the metal shelf 172, the glass shelf 171, and the cover 110 may include circular holes through which the knob 130*b* may pass.

The knob 130*b* may be operated separately from the cover frame 120. The cover 110 included in the refrigerator 1 according to the second embodiment may be configured to be connected to the rotating knob 130*b* so that the cover 110 may be rotated in the vertical direction. Therefore, the gap G between the cover 110 and the storage box 100 may be formed.

The refrigerator 1 according to the second embodiment may include a screw member 160 connected to the rotating knob 130*b*, configured to perform a spiral motion, and passing through the cover 110.

The glass shelf 171 and the cover 110 may include a coupling member for interlocking with the screw member 160. The screw member 160 may pass through the opening of the cover frame 120.

Figure 11:
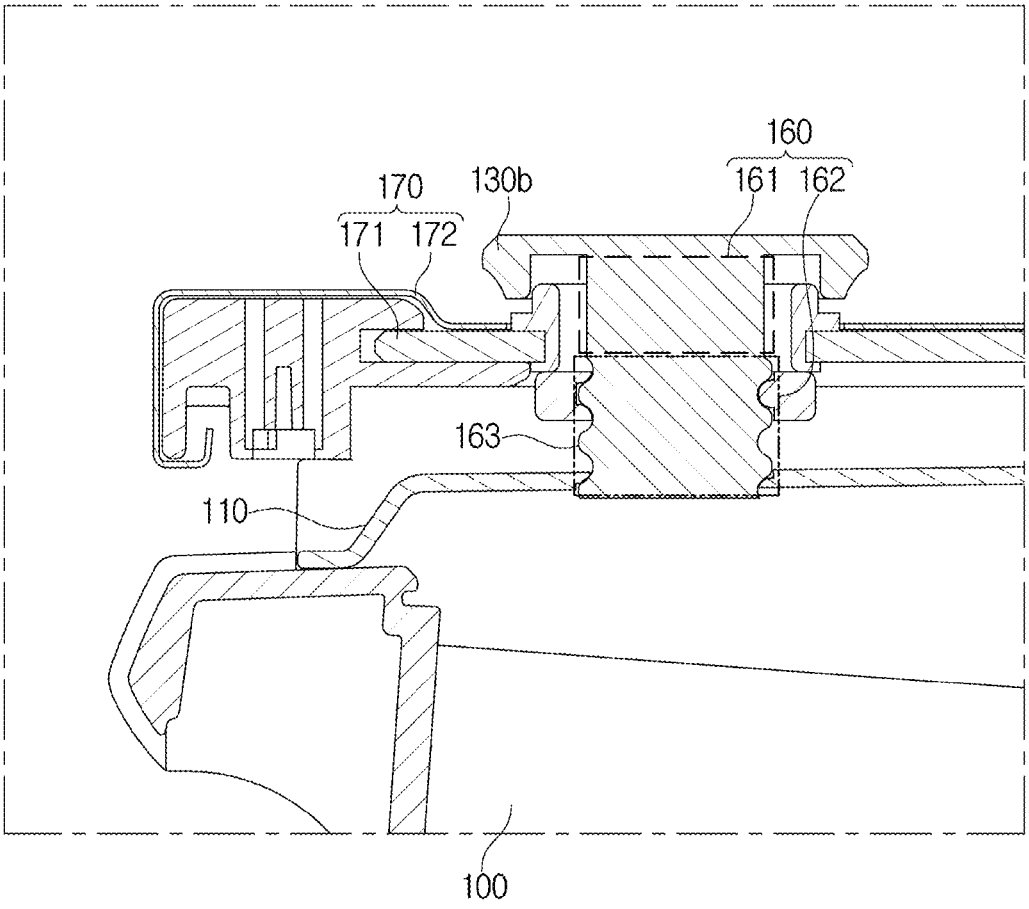
FIG. 11 is a view showing a state before a cover is rotated upward by a knob in the refrigerator according to the second embodiment of the present disclosure.
Figure 12:
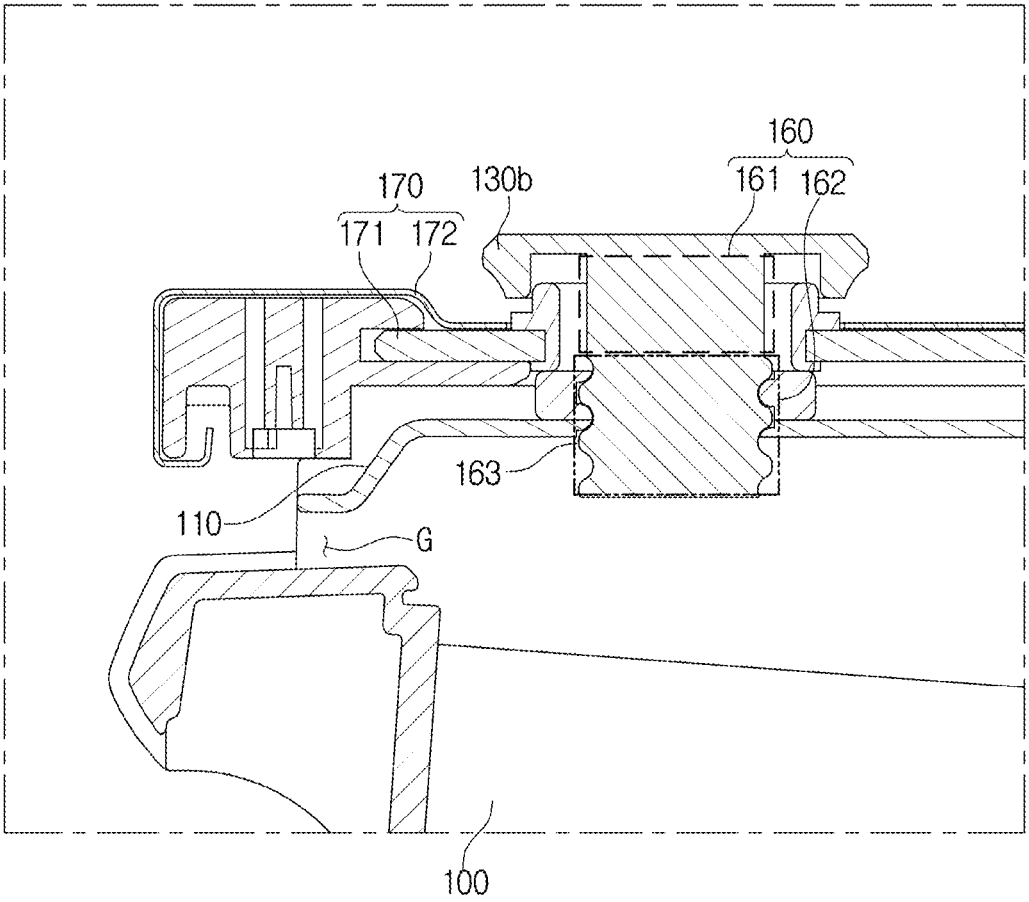
FIG. 12 is a view showing a state after the cover is rotated upward by the knob in the refrigerator according to the second embodiment of the present disclosure.

FIG. 11 is a view showing a state before the cover is rotated upward by the knob in the refrigerator according to the second embodiment of the present disclosure. FIG. 12 is a view showing a state after the cover is rotated upward by the knob in the refrigerator according to the second embodiment of the present disclosure.

As shown in FIGS. 11 and 12, the screw member 160 included in the refrigerator 1 according to the second embodiment may include a first screw member 161 in contact with the cover shelf 170, and a second screw member 162 extending from the first screw member 161.

The second screw member 162 may include a spiral portion 163 in contact with the cover 110. The cover 110 may be configured to rotate in the vertical direction due to the spiral portion 163 configured to perform a spiral motion. The knob 130*b* may be rotated at a fixed position.

That is, when the knob 130*b* is rotated, the screw member 160 may also perform spiral motion together with the knob 130*b*. However, since the cover shelf 170 and the first screw member 161 do not interfere with each other in spite of the spiral motion of the first screw member 161, the first screw member may perform the spiral motion without interfering with the cover shelf 170 connected to the first screw member.

On the other hand, the cover 110 and the spiral portion 163 connected to the second screw member 162 may interfere with the second screw member 162. The cover 110, which interferes with the spiral portion 163 due to the spiral motion of the second screw member 162, may be moved in the vertical direction.

Accordingly, the cover 110 may have the gap G with the storage box 100 due to the spiral motion of the second screw member 162.

The upward and downward movement of the cover 110 may be limited by a length of the spiral portion 163. The downward movement of the cover 110 may be limited by a lower end of the spiral portion 163, and the upward movement of the cover 110 may be limited by an upper end of the spiral portion 163.

That is, the cover 110 may be moved within a range of the second screw member 162 including the spiral portion 163.

Although not shown in the drawings, the refrigerator 1 according to the embodiments of the present disclosure may include various embodiments in addition to the first embodiment and the second embodiment.

For example, a refrigerator (not shown) according to a third embodiment may include knobs (not shown) arranged on both sides of an adjusting member (not shown) and a cover frame (not shown).

The adjusting member (not shown) may include first adjusting members (not shown) connected to the knobs (not shown), and second adjusting members (not shown) bent and extending from one ends of the first adjusting members (not shown) and provided to move cams (not shown).

That is, the plurality of knobs (not shown), first adjusting members (not shown), and second adjusting members (not shown) may be provided, and the number thereof may preferably be two.

According to the third embodiment, inclined portions (not shown) of the second adjusting members (not shown) may have the same shape and length for each second adjusting member (not shown). Meanwhile, the plurality of knobs (not shown) may form a coupling relationship with each other so that one knob (not shown) may be slid in conjunction with movement of the other knob (not shown).

Also, a refrigerator (not shown) according to a fourth embodiment may include a knob (not shown), an adjusting member (not shown), and a screw member (not shown). The screw member (not shown) may perform a spiral motion in conjunction with the rotating knob (not shown).

The adjusting member (not shown) may be configured to move a cover (not shown) in a vertical direction by being connected to the screw member (not shown).

That is, the refrigerator (not shown) according to the fourth embodiment may include the adjusting member (not shown) corresponding to the adjusting member 140 of the refrigerator 1 according to the first embodiment, and the knob (not shown) and the screw member respectively corresponding to the knob 130*b* and the screw member 160 of the refrigerator 1 according to the second embodiment.

As is apparent from the above description, a refrigerator according to the embodiments of the present disclosure can maintain quality of food stored therein by keeping a storage box closed and maintaining humidity of an inside of the storage box at a high level.

Further, the refrigerator according to the embodiments of the present disclosure can maintain freshness of food stored therein according the type of stored food by having a simple structure that can adjust humidity inside the storage box through movement of the cover when it is necessary for the humidity inside the storage box to be kept at a low level.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A refrigerator comprising:

a body having a storage compartment;

a storage box installed to be drawable in the storage compartment;

a cover located above the storage box and provided to be rotatable, the cover including cams protruding from both sides thereof;

a cover frame configured to support the cover, the cover frame including:

a guide groove provided in a bottom surface of the cover frame, and an adjusting member inserted into the guide groove, provided at a lower portion of the cams to move the cams; and a knob engaged with the adjusting member, configured to slide the adjusting member in one direction to rotate the cover to adjust humidity inside the storage box.

2. The refrigerator of claim 1, wherein the cover frame includes a hook configured to be hook-coupled with the cover.

3. The refrigerator of claim 2, wherein the cover includes a pin coupled to the hook and located on a rear surface of the cover.

4. The refrigerator of claim 1, wherein the cover is configured to have a gap with the storage box in conjunction with the knob sliding in one direction.

5. The refrigerator of claim 1, wherein the adjusting member includes a first adjusting member connected to the knob and second adjusting members bent and extending from both ends of the first adjusting member.

6. The refrigerator of claim 5, wherein the second adjusting members include an inclined portion configured to come into contact with the cams to move the cams in a vertical direction.

7. The refrigerator of claim 6, wherein the second adjusting members are provided, and the inclined portions thereof have different shapes so that the second adjusting members simultaneously move the cams.

8. The refrigerator of claim 1, wherein the adjusting member includes a first adjusting member connected to the knob and second adjusting members bent and extending from both ends of the first adjusting member to move the cams.

* * * * *